US005878796A

United States Patent [19]

Phallen

[11] Patent Number: 5,878,796

[45] Date of Patent: Mar. 9, 1999

[54] PARALLEL PROCESSING IN-LINE LIQUID FILLING MACHINE

[75] Inventor: Iver J. Phallen, Youngstown, N.Y.

[73] Assignee: Oden Corporation, Buffalo, N.Y.

[21] Appl. No.: 955,962

[22] Filed: Oct. 22, 1997

[51] Int. Cl.[6] ..... B65B 1/04; B65B 3/04

[52] U.S. Cl. ..... 141/169; 141/180

[58] Field of Search ..... 141/169, 170, 141/176, 178, 179, 180, 181, 183, 184, 185, 186, 188, 237, 246

[56] References Cited

U.S. PATENT DOCUMENTS 648,138 4/1900 Adams et al. .
2,566,677 9/1951 Rapp .
2,932,330 4/1960 Donofrio .
3,036,604 5/1962 Donofrio .
3,322,167 5/1967 Rosen .
4,073,322 2/1978 Bennett .

*Primary Examiner*—Steven O. Douglas
*Attorney, Agent, or Firm*—John C. Thompson

[57] ABSTRACT

A liquid filling apparatus and a method of filling a plurality of containers C arranged in equal numbers in two or more parallel rows, all containers in all rows being first simultaneously and completely filled with a liquid during a fill time period, and then simultaneously released and replaced with empty containers during an index time period, each container row being positioned such that it is at least entirely offset or staggered from the position of the containers in the next adjacent and all other parallel rows, thus allowing simultaneous parallel filling followed by simultaneous parallel indexing of all containers in all rows without the possibility of one container group in any given row intersecting or colliding with any other container group in any other row following release from the filling positions.

8 Claims, 9 Drawing Sheets

PARALLEL PROCESSING IN-LINE LIQUID FILLING MACHINE

TECHNICAL FIELD

The present invention relates generally to a liquid filling apparatus and a method of filling a plurality of containers arranged in equal numbers in two or more parallel rows, all containers in all rows being first simultaneously and completely filled with a liquid during a fill time period, and then simultaneously released and replaced with empty containers during an index time period, each container row being positioned such that it is at least entirely offset or staggered from the position of the containers in the next adjacent and all other parallel rows, thus allowing simultaneous parallel filling followed by simultaneous parallel indexing of all containers in all rows without the possibility of one container group in any given row intersecting or colliding with any other container group in any other row following release from the filling positions, such arrangement of simultaneous filling and indexing of all rows being referred to as a parallel processing in-line liquid filling machine.

BACKGROUND OF THE INVENTION

Fully Automatic Liquid Filling machines of known construction may be generally divided between two major architectural types or categories based upon their speed capabilities. Speed in this context refers to the number of containers or packages which are filled by the machine with a liquid product within a given time interval, most commonly expressed as containers per minute.

One major category of liquid filling machines are referred to as rotary fillers. These machines are characterized by their continuous motion, in which an array of filling nozzles or orifices rotate about a central spindle in a continuous circular manner. Empty containers to be filled with liquid are synchronously introduced into the machine and travel about the circumference of the structure. While each container is positioned under a circumferentially arranged filling nozzle, it is completely filled with liquid. Each container is so positioned for most of one complete revolution of the machine before it is synchronously removed from the machine. Practical limitations prevent the container from being filled for much more than 270 degrees of rotation of the 360 available. Nevertheless, it is apparent that even within this constraint the rotary filler is the fastest known architecture in that its motion is continuous and to increase its speed capabilities it is only necessary to increase the diameter of the machine, thus greatly increasing its circumference and thus allowing more room for additional filling positions. It can be shown that at a given rate of rotation, a rotary filler's container per minute output will increase in direct proportion to the increase in the number of filling positions fitted to the machine.

The second major category of liquid filling machines is referred to as in-line fillers. These machines may also be characterized by their motion which is asynchronous or intermittent. In this design, a plurality of containers to be filled typically are serially conveyed as a group into the machine and captured or indexed into position under filling nozzles or orifices. Most typically, the containers are then completely filled while they remain fixed and motionless. Upon completion of the fill, the container capture or indexing mechanism allows the filled containers to exit the filling area on the same conveyor which mediated their entry, and another plurality of containers are conveyed into position to be filled, and the sequence of events is repeated.

When compared to the rotary filling machine, the in-line architecture is clearly slower in potential containers per minute of output. It is possible to increase the speed of an in-line filler by the addition of filling positions. However, as each additional filling position is added, total machine output per minute increases at a decreasing rate per added position and eventually begins to decrease in total containers per minute of output. This is because as the number of containers to be filled in each machine cycle is increased, the indexing or transfer time of containers entering in to and out of the machine becomes an ever greater proportion of the machine's total cycle time. Thus, while the speed performance of an in-line machine can be improved, it is always at a fundamental architecturally based disadvantage when compared with a rotary design. The precise point at which attempts to speed up an in-line machine to approach or match rotary speeds varies technically and economically as a function of many variables, principle among them being the size of the liquid fill dose, the rheology of the liquid to be filled, and the size and shape of the container. In the vast majority of cases, the rotary design begins to dominate applications where speed requirements exceed 150 to 200 filled containers per minute, or where an in-line filler fitted with more than 12 to 16 filling positions is needed to satisfy required speeds.

Despite the limitation in speed associated with in-line automatic liquid filling machines of known type, these designs generally possess many technical capabilities of great merit (herein referred to as characteristics of merit) which are difficult or impractical or uneconomical to duplicate within the rotary filler design envelope. These capabilities include: the ability to simply and economically provide means to lower or dive the filling nozzles into the container for precise bottom-up or subsurface filling; the ability to vacuum aspirate the filling nozzles to prevent dripping following subsurface filling; the ability to readily and simply implement real time no container-no fill detection and inhibition functions, particularly in all filling positions; the ability to readily use many different types of filling nozzles, including bottom shut-off or positive shut-off filling nozzles; the ability to readily add or delete filling positions on the machine in a modular manner; the ability to readily implement a nitrogen (or other gas) pre-fill container purge, concurrent fill container gas purge, or post-fill container gas purge function; the ability to readily adjust filling volumes or levels or weights while the machine is operating (termed on the fly adjustment); the ability to separately and discretely adjust and alter the various machine functions and timing relationships; and the ability to locate and capture the neck or body of each container to assure proper position and alignment of the container with the filling nozzle during filling or to assure proper positioning of a filling nozzle for lowering onto or into the container prior to filling.

Additional important capabilities of in-line liquid filler designs of known type which are relatively distinct from known rotary designs include the typically greater speed and ease of product changeover of an in-line machine from one product type or container size to another. This fast changeover capability is a corollary to the relatively great and most significant distinction between in-line and rotary machines which is in regard to machine flexibility and versatility of usage which refers to the broad range of container sizes and shapes and the broad range of different types of liquid products which can be run on an in-line machine without need of change parts or machine additions or alterations. By way of example and illustration of this distinction, consider the PRO/FILL 3000 single lane in-line fully automatic liquid fillers manufactured by Oden Corporation of Buffalo, N.Y. A filling machine of this type, without change in physical design or fitments (sometimes referred to as change parts) of any kind, can completely and efficiently fill small round containers with two ounces of a low viscosity water-like liquid into oval shaped bottles, then can fill F-style 2.5 gallon jugs with motor oil, then can fill peanut butter into 12 oz. tapered glass jars, then can fill a thick cosmetic cream into four ounce square plastic containers, then can fill twenty ounces of honey into plastic containers shaped like a bear, then can fill highly foamy floor cleaner into plastic gallon jugs. No rotary filling machine of known type can meet this same test of flexibility and versatility.

Bearing in mind the above characteristics of merit of in-line liquid fillers, it is clear why numerous attempts have been made to increase the speed capabilities of in-line machines to rival rotary filler speeds. For comparative purposes, a single lane in-line machine of substantially standard type can be contrasted with known higher speed in-line derivatives. These derivative designs of known type include the dead plate pushover design, the shifting nozzle dual lane design, and the walking beam design. U.S. Pat. No. 3,036,604 discloses a bidirectional shuttle mechanism which moves containers onto a dead plate for filling. Thus dual lane design uses a dual lane feed, with the discharge merging into a single lane. This is a variation on the basic design of the prior art dead plate pushover design disclosed in FIG. 2 of this application. U.S. Pat. No. 3,322,167 discloses a shifting nozzle dual lane filler of the type disclosed in FIGS. 3 and 4 of this application. It is only through a comparative study and analysis of these known derivative designs that the unique and novel characteristics and advantages of the present invention will be clear. The prior art disclosed in this application will be discussed further after the following recitation of the objects of this invention, and the brief description of the various figures.

OBJECTS AND SUMMARY OF THE INVENTION

It is a primary object of the present invention to overcome the numerous disadvantages and limitations of in-line filling machines of known type, as set forth above. More specifically, it is a primary object of the present invention to simplify the layout and construction of an in-line liquid filler offering increased speed capability compared with single lane in-line machines and compared with enhanced speed in-line derivatives of known types operating under most conditions; to provide an architecture offering enhanced performance at a potentially lower economic cost when compared to other enhanced performance in-line liquid fillers; to disclose an enhanced performance in-line liquid filler design which does not require additional complex motions or apparatus or mechanisms to achieve increased speeds when compared with single lane in-line fillers and enhanced speed in-line derivatives; to disclose an increased speed in-line liquid filler which minimizes the loss or reduction in characteristics of merit of single lane in-line liquid filler designs when compared with such losses or reductions necessitated by other higher speed in-line designs of known type. It is also particularly an object of the present invention to detail a novel in-line liquid filler design of higher speed capability when compared to a conventional single lane in-line design, which preserves, intact, the essential simplicity and ease of set-up and operation and changeover which is inherent in the single lane in-line design.

The present invention relates to an in-line filler in which the container conveyor has been divided into two or more lanes. Each lane is jam fed with the containers to be filled, in the same manner as in conventional single lane and multiple lane in-line filling machines of known type.

Each lane of the conveyor is provided with a means of indexing containers in groups of any number, each group being equal in number of containers to every other group, such that each group of empty containers is positioned under a suitable filling apparatus, the containers are filled with liquid, and the filled containers are released to move on the conveyor out of the filling position, to be replaced by another group of containers. Many means of indexing containers for this purpose are known including servo indexing timing screws, dual pin or gate mechanisms, and starwheels, and all are suitable for the task in the present invention.

Regardless of the indexing method, the present invention is novel and unique in that the plurality of containers to be filled in any one lane are not adjacent to any other plurality of containers to be filled in any other lane. In effect, each group of containers, when positioned for filling on any given lane of the machine, are completely offset or staggered in their location on the conveyor relative to any other group of containers of equal number. The result of the novel arrangement of containers described above is that when simultaneous indexing of containers occurs on each lane of the machine, the transfer or indexing time, the period required for a group of filled containers to move out of the filling area to be replaced by a group of empty containers, is reduced in a manner directly proportional to the ratio of the number of containers in each group as it bears to the sum total number of containers in all groups. For example, in a two parallel lane machine with ten filling positions, each lane would index a group of five containers simultaneously. While a total of ten containers move through the machine with each cycle, the transfer or indexing time is not that for ten, but rather is that for five. Essentially, in this example, the indexing time is reduced by half. Because the container indexing time is greatly reduced as a result of the novel architecture of the machine of present invention, the cycle time of the machine is substantially reduced which results in a much higher number of filled containers per minute being produced.

As another primary object of the present invention, the machine herein disclosed is designed to minimize the addition of complex motions, or apparatus, or mechanisms, or cycle time components to achieve increased speeds when compared with single lane in-line fillers and with enhanced speed in-line derivatives.

As another primary object of the present invention, the machine herein disclosed is designed to minimize the loss or reduction in characteristics of merit of single lane in-line liquid filler designs, particularly when compared with such losses or reductions necessitated by other higher speed in-line designs of known type.

These and other objects and advantages of this invention will be apparent to one having ordinary skill in the art after a consideration of the following detailed description taken in conjunction with the accompanying drawings.

DETAILED DESCRIPTION IN GENERAL

Figure 1:
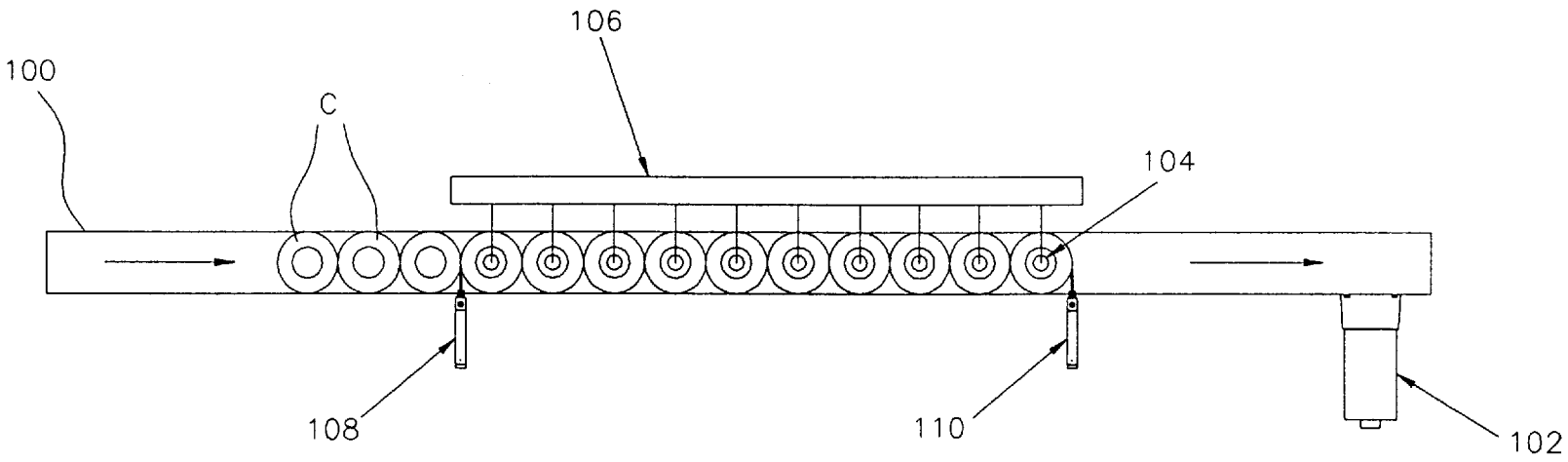
FIG. 1 PRIOR ART
FIGS. 1 to 1B are schematic illustrations of a prior art single in-line liquid filling machine, FIG. 1 being a plan view, FIG. 1A being a side elevational view, and FIG. 1B being an end view.
Figure 1A:
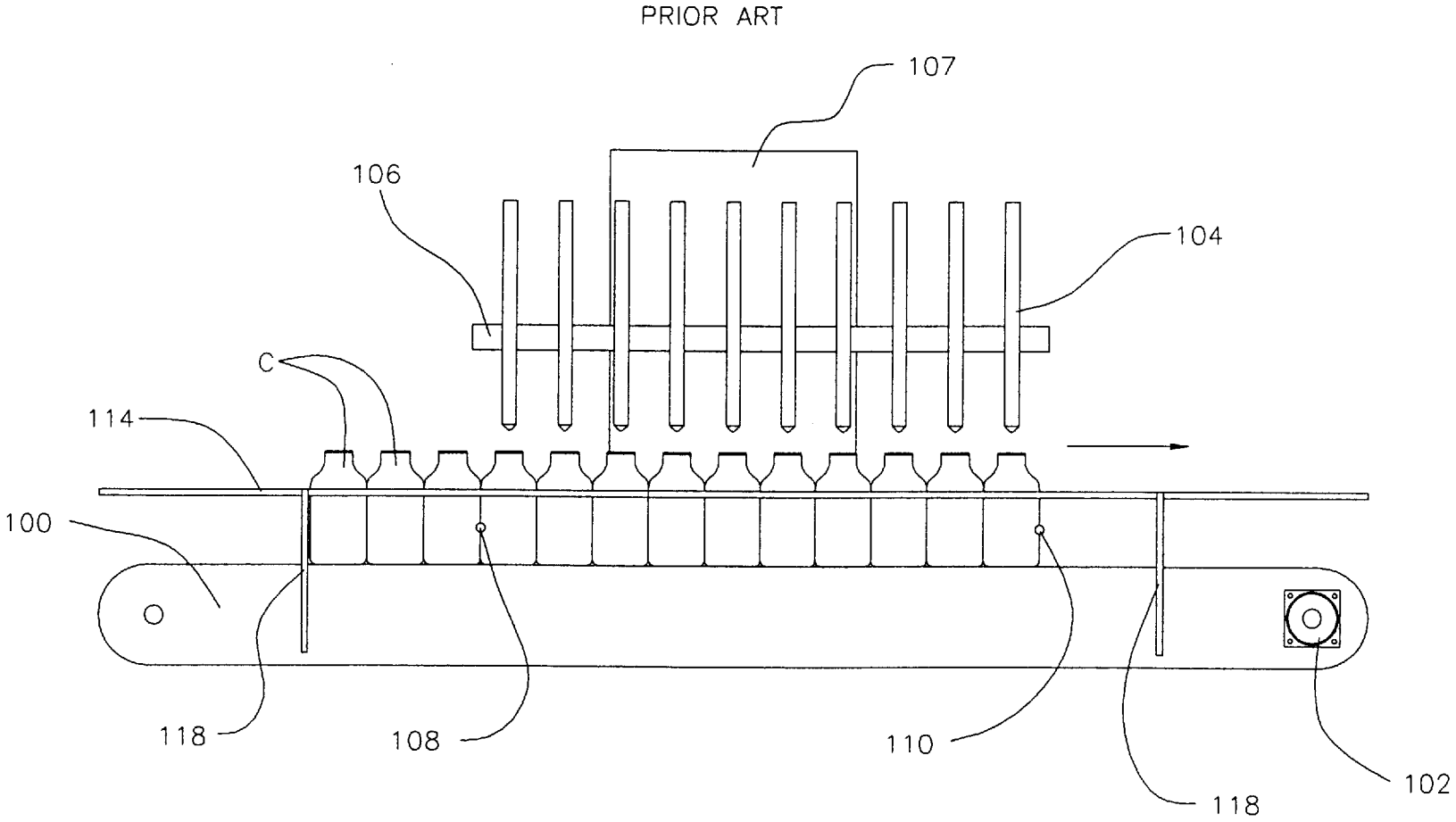
FIG. 1A PRIOR ART
Figure 1B:
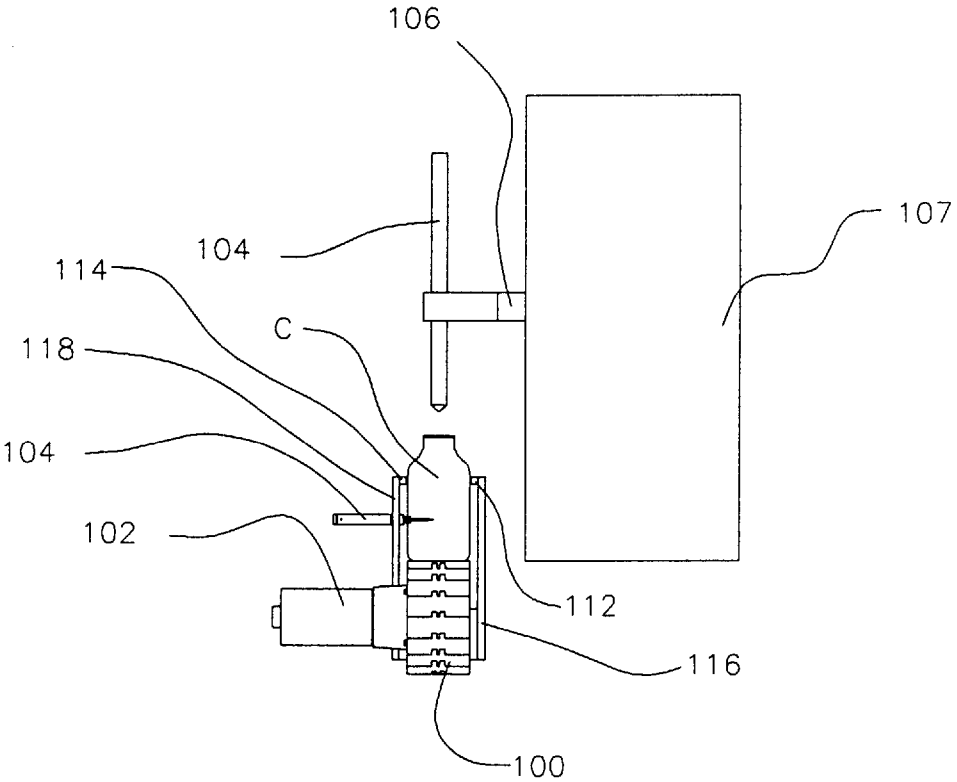
FIG. 1B PRIOR ART

FIGS. 1 to 1B illustrate, in schematic form, a typical prior art single lane in-line filling machine. This machine consists of a single powered conveyor 100 suitably driven by a drive 102. A row of individual containers C are supported on the conveyor. Filling nozzles 104 are supported by a filling nozzle mount beam 106 which can be moved up and down by a diver mechanism 107, the nozzles 104 being shown in their raised position in FIGS. 1A and 1B. The movement of the containers C past the filling nozzles is controlled by an index gate 108 and a fill gate 110 in a conventional manner, and the containers are guided on the conveyor 100 by guide rails 112 and 114 which are carried by supports 116 and 118.

The major machine functions which typically contribute to a total machine cycle time are listed in Table 1. The container index time constitutes the time required for a group of filled containers (in this example, ten) to leave the ten filling station area and be replaced by ten empty containers. The nozzle dive time is the period from the start of downward travel of the filling nozzles until the nozzles are fully lowered to the desired position about or onto or inside of the containers. The container fill time is the absolute filling time required to deliver the desired quantity of liquid into the container, from start of liquid flow to the end of liquid flow. The nozzle retract time is the interval of time from the start of nozzle withdrawal from within or about the container to the return of the filling nozzles to a full up position. This motion is the reverse of the nozzle dive motion. Taken together, these functions constitute a complete machine cycle of a typical in-line liquid filling machine. The example of output speed given in Table 1 is based upon the machine operating parameters listed, which are reasonable and typical, and also on a conveyor speed of 50 feet per minute and a container diameter of 3 inches, which gives an index time of 300 mS per container. Computations for three different absolute fill times are given.

By comparative examination of the results given in Tables 2–4, which are based upon the machine operating parameters of Table 1, but with differing numbers of fill positions, it can be seen that regardless of the container fill time, which is varied in these examples by a factor of four, the addition of filling positions results in an increase in speed which is well below the percentage increase in filling positions. To look at only one specific example of this, in the case of a 10% increase in filling positions from 10 to 11, output increases by 5.5% in the best case and 3.47% in the worst. In actual practice, results can be even worse because larger fill sizes generally mean containers which are larger in the axis of index motion which further degrades speed gains from nozzle additions because of the longer indexing times. It should also be noted that the computations illustrate that with the continuing addition of filling positions the absolute and percentage increase in speed continues to diminish in a

TABLE 1

SPEED CAPABILITY OF A SINGLE LANE IN-LINE FILLER

| Machine Function Times (mS) | Fill Time A 750 (ms) | Fill Time B 1500 (mS) | Fill Time C 3000 (mS) |
|---|---|---|---|
| Container Index Time | 3000 | 3000 | 3000 |
| Nozzle Dive Time | 500 | 500 | 500 |

TABLE 1-continued

SPEED CAPABILITY OF A SINGLE LANE IN-LINE FILLER

| Machine Function Times (mS) | Fill Time A 750 (ms) | Fill Time B 1500 (mS) | Fill Time C 3000 (mS) |
|---|---|---|---|
| Container Fill Time | 750 | 1500 | 3000 |
| Nozzle Retract Time | 500 | 500 | 500 |
| Total Cycle Time | 4750 | 5500 | 7000 |
| Cycles Per Minute | 12.63 | 10.91 | 8.57 |
| Containers Per Minute | 126.3 | 109.1 | 85.7 |

TABLE 2

EFFECTS ON SINGLE LANE IN-LINE FILLING MACHINE SPEED WITH ADDITION OF FILLING POSITIONS: 750 mS CONTAINER FILL TIME

| Number of Filling Positions | Containers per minute | Unit Increase | Percent Increase |
|---|---|---|---|
| 10 | 126.3 | — | — |
| 11 | 130.68 | 4.38 | 3.47 |
| 12 | 134.64 | 3.96 | 3.03 |
| 13 | 138.06 | 3.42 | 2.54 |
| 14 | 141.12 | 3.06 | 2.22 |
| 15 | 144 | 2.88 | 2.04 |
| 16 | 146.56 | 2.56 | 1.77 |

TABLE 3

EFFECTS ON SINGLE LANE IN-LINE FILLING MACHINE SPEED WITH ADDITION OF FILLING POSITIONS: 1500 mS CONTAINER FILL TIME

| Number of Filling Positions | Containers Per Minute | Unit Increase | Percent Increase |
|---|---|---|---|
| 10 | 109.1 | — | — |
| 11 | 113.85 | 4.75 | 4.35 |
| 12 | 118.08 | 4.23 | 3.72 |
| 13 | 121.94 | 3.86 | 3.27 |
| 14 | 125.44 | 3.5 | 2.87 |
| 15 | 128.55 | 3.11 | 2.48 |
| 16 | 131.52 | 2.97 | 2.31 |

TABLE 4

EFFECTS ON SINGLE LANE IN-LINE FILLING MACHINE SPEED WITH ADDITION OF FILLING POSITIONS: 3000 mS CONTAINER FILL TIME

| Number of Filling Positions | Containers Per Minute | Unit Increase | Percent Increase |
|---|---|---|---|
| 10 | 85.7 | — | — |
| 11 | 90.42 | 4.72 | 5.5 |
| 12 | 94.8 | 4.38 | 4.84 |
| 13 | 98.8 | 4 | 4.22 |
| 14 | 102.48 | 3.68 | 3.73 |
| 15 | 105.9 | 3.42 | 3.34 |
| 16 | 109.12 | 3.22 | 3.04 |

non-linear and unfavorable manner. It is important to understand that the filling apparatus added at each filling position is typically the most expensive element of an in-line liquid filling machine and thus practical limits of cost are quickly reached, as are limitations of size and burden of set-up and changeover time with increasing machine scale.

Figure 2:
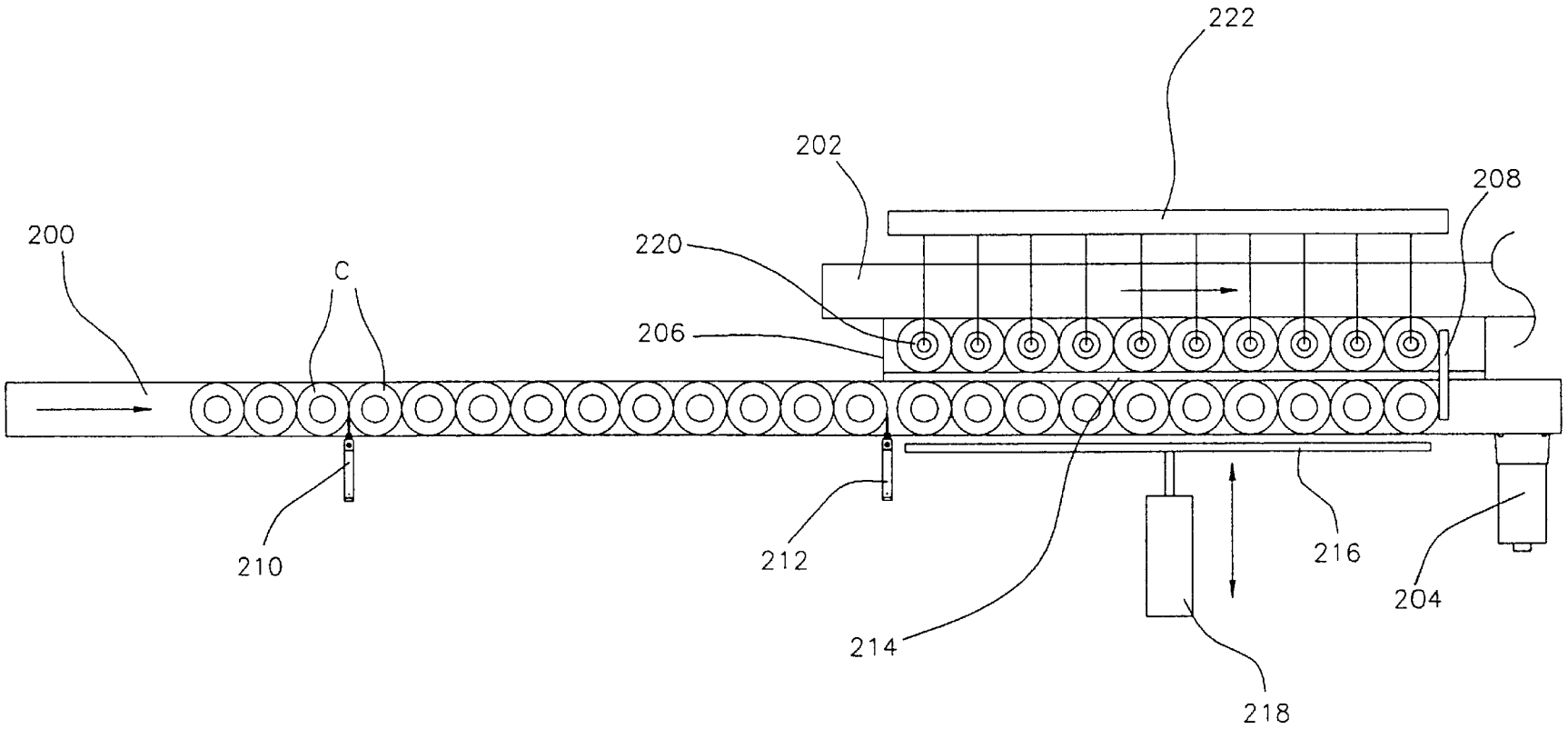
FIG. 2 PRIOR ART
FIG. 2 is a schematic plan view of a prior art dead plate pushover in-line liquid filling machine.

The first higher speed in-line filler derivative of known type to be compared with the single lane in-line filler is termed the dead plate pushover design. FIG. 2 illustrates a simplified schematic illustration of a typical dead plate push over design, presented in plan view. This design consists of two powered conveyors 200 and 202, a first 200 being termed the container feed conveyor, and the second 202 the container take away conveyor. The conveyors are driven by a suitable drive, one being illustrated at 204. The discharge end of the feed conveyor overlaps the infeed end of the take away conveyor by a suitable interval to accommodate a common length greater than the container to container dimension defined by the number and diameter of containers to be run on the machine. Interposed between the overlap area is a smooth surface 206, typically a polished stainless steel plate, the width of which is only equal to or somewhat greater than the diameter of the container C to be filled on the machine. This plate, termed the dead plate, is flush with the two conveyor chain surfaces such that a container can be pushed at 90 degrees from the direction of its travel on the container feed conveyor 200 over onto the dead plate 206 and, ultimately, onto the container take away conveyor 202. Suitable container guide rails are affixed to the sides of the conveyors and an end stop 208 is fixed to the discharge end of the container feed conveyor to prevent containers from falling off the end of the conveyor. This end stop also extends across the width of the dead plate. Immediately upstream from the dead plate, two suitable container indexing gates are affixed to the container feed conveyor. The most upstream gate 210 is termed the index gate and the gate 212 closest to the dead plate is termed the fill gate. When extended across the container feed conveyor the fill gate holds back the jam fed row of containers such that the containers adjacent to the dead plate are not in contact with the fill gate or the containers upstream from it. This separation of the plurality of containers adjacent to the dead plate is crucial to allow these containers to be freely moved or pushed over onto the dead plate later in the machine cycle. Interposed between the dead plate and the edge of the container feed conveyor common to it is a retractable blade 214, termed the index backer blade. This blade moves up and down vertically. When down, the blade forms a smooth lamina between the dead plate and conveyor chain which does not interfere with the movement of containers off of the container feed conveyor and onto the dead plate. When raised, the blade serves as a backer rail to allow containers to be properly guided and contained while being indexed into the area adjacent to the dead plate. This function is crucial to prevent containers entering the area adjacent to the dead plate from contacting or perturbing containers already positioned on the dead plate. On the side of the container feed conveyor opposite the index backer blade, a container push bar 216 is mounted on a push bar drive mechanism 218. This bar is capable of movement horizontally across the container feed conveyor. When retracted, it is even with or outside of the guide rails of the feed conveyor and may, in some alliterations, serve as the container guide rail during indexing of containers into the dead plate area. When extended, the push bar travels nearly to the far edge of the dead plate.

In operation, with the index backer blade 214 down, the container push bar 216 moves a set of ten (in this example) empty containers C off of the container feed conveyor 200 onto the dead plate 206. This is termed the push over function. These empty containers, in turn, push ten filled containers onto the take away conveyor 202. The container push bar 216 then retracts and the index backer blade 206 is raised. At this point in the machine cycle, two functions occur simultaneously. Filling nozzles 220, which are carried by the filling nozzle mount beam 222, begin to dive onto, into or about the containers positioned on the dead plate, and the fill gate 212 retracts allowing ten empty containers to begin to enter the pushover area. After the nozzles are fully lowered to the desired position onto, about or inside of the containers, filling begins, followed by nozzle retraction. Meanwhile, indexing is occurring. The dive-fill-retract functions can be considered identical to those on a single lane machine as can the indexing of containers into the dead plate pushover area. The key concept to grasp here is that the interval between filling is not necessarily the serial indexing period as with a single lane machine, but rather can be the sum of the push over functions. Since the pushover distance is only slightly greater than one container diameter, it can be much faster than serial indexing.

Table 5 shows computations for machine functions and output speeds at three different fill times for a ten filling station dead plate push over design, and Tables 6–8 show computations with differing numbers of fill positions. For ease of comparison with Tables 1–4, the functions common with the single lane in-line design have the same values. In each case, the dead plate push over design is substantially faster than a single lane system.

TABLE 5

COMPARATIVE SPEED CAPABILITY OF A DEAD PLATE PUSH OVER IN-LINE FILLER

| | Machine Function Times (mS) | Fill Time A 750 (mS) | Fill Time B 1500 (mS) | Fill Time C 3000 (mS) |
|---|---|---|---|---|
| T1 | Container Pushover Time | 500 | 500 | 500 |
| T2 | Push Bar Retract Time | 300 | 300 | 300 |
| T3 | Raise Index Backer Blade Time | 150 | 150 | 150 |
| T4 | Serial Index Time | 3000 | 3000 | 3000 |
| T5 | Nozzle Dive Time | 500 | 500 | 500 |
| T6 | Container Fill Time | 750 | 1500 | 3000 |
| T7 | Nozzle Retract Time | 500 | 500 | 500 |
| T8 | Drop Index Backer Blade | 150 | 150 | 150 |
| | Time | | | |
| | Total Cycle Time (See Note 1) | 4100 | 4100 | 5100 |
| | Cycles Per Minute | 14.63 | 14.63 | 11.77 |
| | Containers Per Minute | 146.3 | 146.3 | 117.7 |

Note 1:
If T4 exceeds the sum of T5 + T6 + T7 then total cycle time equals T1 + T2 + T3 + T4 + T8. If T4 is less than the sum of T5 + T6 + T7, then total cycle time equals T1 + T2 + T3 + T5 + T6 + T7 + T8.

TABLE 6

COMPARATIVE EFFECTS ON DEAD PLATE PUSH OVER FILLING MACHINE SPEED WITH ADDITION OF FILLING POSITIONS: 750 mS CONTAINER FILL TIME

| Number of Filling Positions | Containers Per Minute | Unit Per Minute | Percent Increase |
|---|---|---|---|
| 10 | 146.3 | — | — |
| 11 | 150.04 | 3.74 | 2.56 |
| 12 | 153.24 | 3.2 | 2.13 |

TABLE 6-continued

COMPARATIVE EFFECTS ON DEAD PLATE PUSH OVER FILLING MACHINE SPEED WITH ADDITION OF FILLING POSITIONS: 750 mS CONTAINER FILL TIME

| Number of Filling Positions | Containers Per Minute | Unit Per Minute | Percent Increase |
|---|---|---|---|
| 13 | 156 | 2.76 | 1.8 |
| 14 | 158.48 | 2.48 | 1.59 |
| 15 | 160.65 | 2.17 | 1.37 |
| 16 | 162.72 | 2.07 | 1.29 |

TABLE 7

COMPARATIVE EFFECTS ON DEAD PLATE PUSH OVER FILLING MACHINE SPEED WITH ADDITION OF FILLING POSITIONS: 1500 mS CONTAINER FILL TIME

| Number of Filling Positions | Containers Per Minute | Unit Per Minute | Percent Increase |
|---|---|---|---|
| 10 | 146.3 | — | — |
| 11 | 150.04 | 3.74 | 2.56 |
| 12 | 153.24 | 3.2 | 2.13 |
| 13 | 156 | 2.76 | 1.8 |
| 14 | 158.48 | 2.48 | 1.59 |
| 15 | 160.65 | 2.17 | 1.37 |
| 16 | 162.72 | 2.07 | 1.29 |

TABLE 8

COMPARATIVE EFFECTS ON DEAD PLATE PUSH OVER FILLING MACHINE SPEED WITH ADDITION OF FILLING POSITIONS: 3000 mS CONTAINER FILL TIME

| Number of Filling Positions | Containers Per Minute | Unit Per Minute | Percent Increase |
|---|---|---|---|
| 10 | 117.7 | — | — |
| 11 | 129.47 | 11.77 | 10 |
| 12 | 141.24 | 11.77 | 9.1 |
| 13 | 153.01 | 11.77 | 8.33 |
| 14 | 158.48 | 5.47 | 3.58 |
| 15 | 160.65 | 2.17 | 1.37 |
| 16 | 162.72 | 2.07 | 1.29 |

Note that in the examples where the container fill times are of 750 mS and 1500 mS duration, the serial indexing time exceeds the sum of the dive, container fill, and nozzle retract times. When this is the case, the serial index time determines the machine's total cycle time and therefore its output speed. This is true because the serial index function and the dive-fill-retract functions start simultaneously, but do not end simultaneously. By the nature of the design, the machine cannot continue to complete the cycle until both concurrent functions have been completed. Because this is true, the examples given, as shown in Tables 6–8, show mathematically that when the serial index time is the greater of the two concurrent events, the addition of filling positions results in exactly the same phenomenon found with such additions on a single lane in-line filler; speeds increase but in an unfavorable way relative to the percentage increase in the number of filling positions. It is also shown that the change in output speed will be identical regardless of the container fill time duration until that duration, when summed with the remaining machine functions other than dive-fill-retract, exceeds the serial index time. When the sum of the container dive-fill-retract times exceed the serial index time, the results of adding filling positions changes markedly. In this case, the addition of each filling position increases the output of the machine in exact proportion to the percent increase in filling positions. Thus, there are two analytical cases for this derivative design and each case gives different results in output speed change with additional filling positions. However, in all cases, this dead plate push over design is faster for an equivalent number of filling positions than a single lane in-line machine.

The dead plate push over design preserves some of the characteristics of merit of in-line fillers while impairing others. Specifically, diving nozzle functions, vacuum aspiration capability, use of many various types of filling nozzles, including positive shut-off nozzles, the ability to implement a gas purge function, on the fly adjustment ability, and the ability to adjust each time segment of the machine cycle separately are all unaffected as a function of the design variant. The modular addition of filling positions is possible with this design but is somewhat complicated by the need to change the container push bar to accommodate a longer span of containers. In terms of ease of changeover, altering the serial index arrangement is no different or more difficult than in the single lane in-line design. However, ease of changeover as well as machine flexibility and versatility are very adversely affected by the dead plate itself. The dead plate must be of the correct width to minimize the push over distance relative to the container size. As container sizes vary, this necessitates different plates and means to adjust the dimensions between adjacent conveyor sections. Thus, change parts became necessary, as well as mechanical alteration of the system. Some further complications to changeover include the need to adjust the speed of two conveyors and the need to adjust container guide rails on two conveyors. Particularly difficult to implement with this design is a no container-no fill function at the container filling positions, as well as a container capture function during filling. This is because an articulating mechanism is necessary to position capture devices and suitable sensors to detect container presence or absence. Multiple axis motion is typically necessary for implementation of a capture mechanism.

Figure 3:
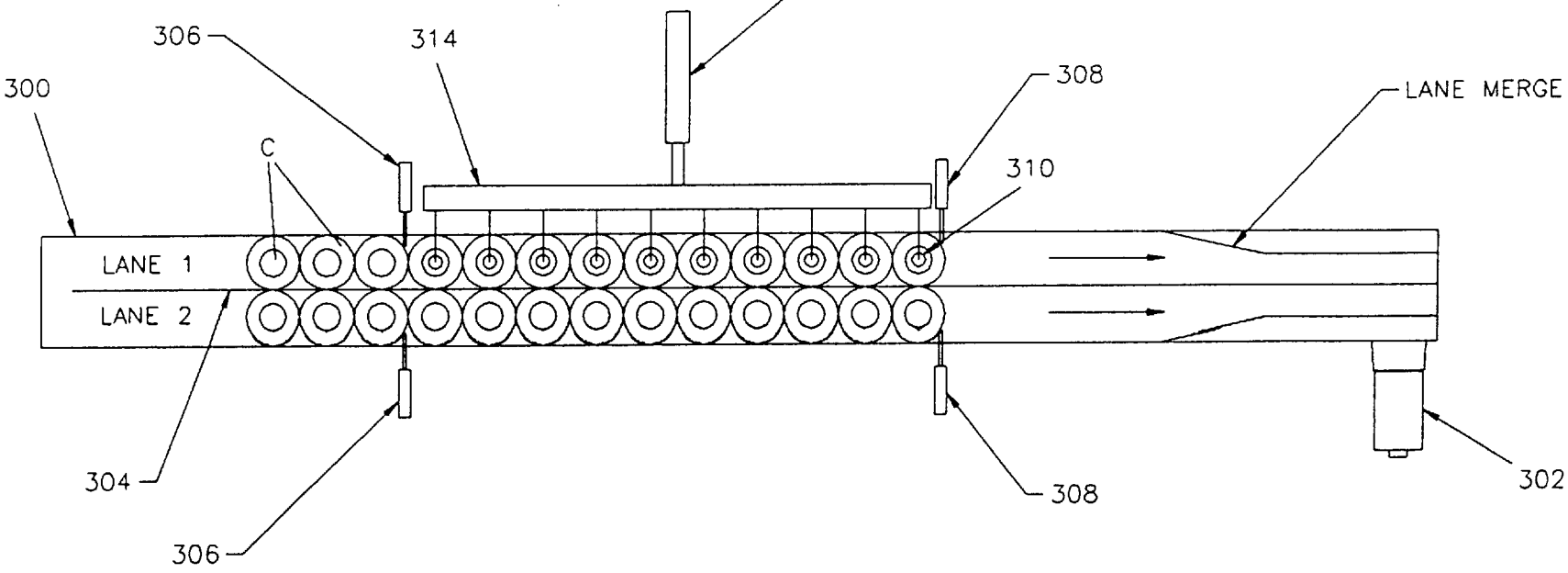
FIGURE 3 PRIOR ART
FIG. 3 is a schematic plan view of a prior art shifting nozzle dual lane design, with filling in lane 1.
Figure 4:
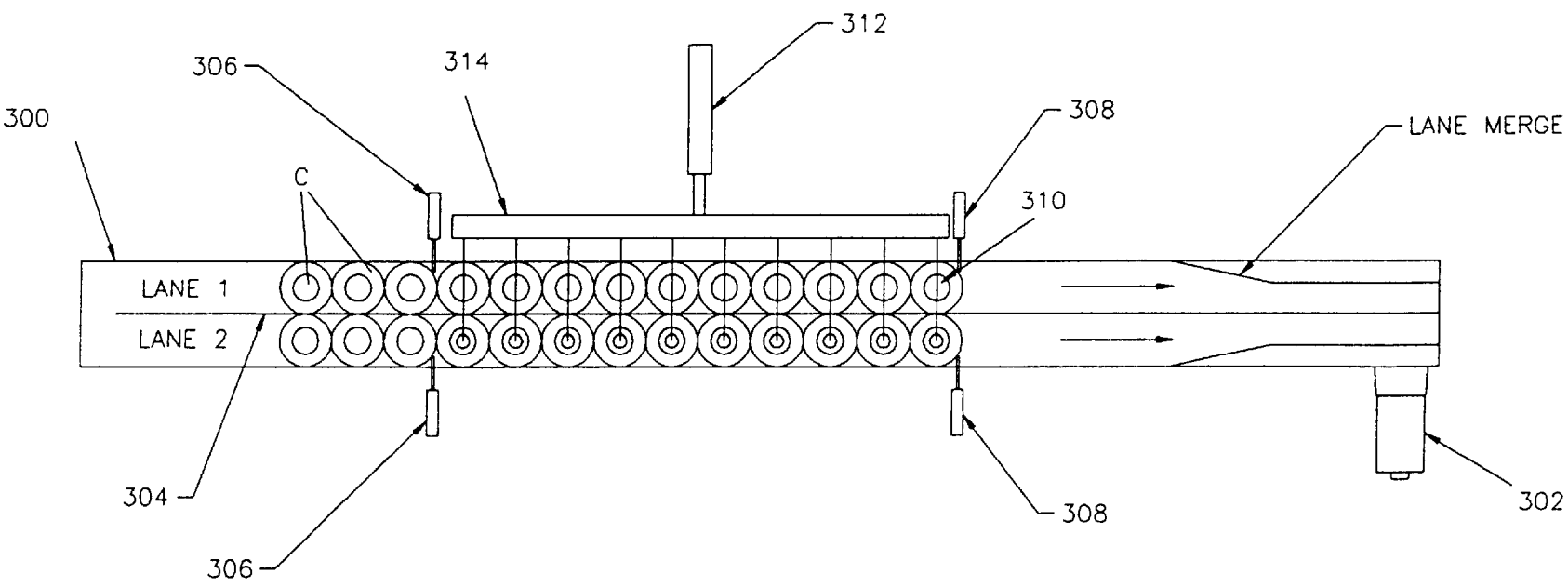
FIGURE 4 PRIOR ART
FIG. 4 is a schematic plan view of the prior art apparatus shown in FIG. 3, but with filling in lane 2.

The second higher speed in-line filler derivative of known type to be compared with the single lane in-line filler is termed the shifting nozzle dual lane design. FIGS. 3 and 4 provide a simplified schematic illustration in plan view of a typical shifting nozzle dual lane design. This design consists of a single powered conveyor, the conveyor 300, driven by a drive 302, being divided in the direction of container travel into two lanes, each capable of guiding and conveying the containers to be filled. The center dividing element 304 between lanes is termed the lane divider. Affixed onto each side of the conveyor are two sets of two indexing gates. In each case, the upstream gate 306 may be termed the index gate and the gate 308 closest to the discharge end of the conveyor may be termed the fill gate. When extended across its lane, a fill gate serves to hold back a jam fed row of containers C, variable in number depending on the scale of the machine, such that they are positioned for filling with liquid by the filling mechanisms associated with the machine. Filling nozzles 310 are affixed to a shifting nozzle mechanism 312 such that the filling nozzles 310, which are carried by a filling nozzle mount beam 314, may be alternately positioned first over a plurality of containers in lane 1, and then over a matching number of containers in lane 2, the lane 2 containers being positioned directly opposite those in lane 1.

In operation these major elements function such that after ten containers (in this example) are positioned for filling in lane 1, the cycle begins when filling nozzles are lowered about or inside of the lane 1 containers. After the nozzles are fully lowered to the desired position filling begins. After liquid filling is completed, the nozzles retract vertically out of or away from the containers. As soon as nozzle retraction on lane 1 is completed, the fill gate on lane 1 is retracted and indexing of containers on lane 1 begins. Also upon the completion of filling nozzle retraction on lane 1, the shifting nozzle mechanism moves the array of nozzles horizontally until they are positioned over the containers in lane 2. When this horizontal shift is completed, if ten containers are positioned for filling, the filling nozzles are lowered about or into the containers and filling of containers on lane 2 begins. While these machine cycle constituent functions are occurring, container indexing continues on lane 1. The duration of indexing on lane 1 is defined by the speed of the conveyor, and the size and nature of the containers, as is the case with any of the designs herein described. Upon the completion of liquid filling on lane 2, the nozzles retract vertically out of or away from the containers. As soon as nozzle retraction on lane 2 is completed, the shifting nozzle mechanism moves the array of nozzles horizontally until they are again positioned over the containers in lane 1. Note that as soon as nozzle retraction is complete on lane 2, container indexing will begin on lane 2, provided that container indexing has been completed on lane 1. This is the case because the group of ten containers previously released on lane 1 must be clear of the fill gate positions on lanes 1 and 2 in order to insure that there cannot be a downstream collision of the lane 1 containers with the lane 2 containers upon their release from their filling location. This is particularly the case because typically the lane 1 and lane 2 containers are merged into a single lane as they move downstream of the filling area. Note also that after the nozzle array has been shifted back to lane 1, the diving nozzle mechanism will begin to lower the nozzles about or onto or inside of the lane 1 containers, provided lane 1 container indexing has been completed. If lane 1 container indexing has not been completed, the start of the diving nozzle portion of the sequence must await the completion thereof.

Table 9 shows computations for machine functions and output speeds at three different fill times for a ten filling station shifting nozzle dual lane design, and Tables 10–12 show computations with differing numbers of fill positions. Note that the functions common with the single lane in-line design and with the dead plate pushover design use the same values. In each comparative case, the shifting nozzle dual lane design in-line filler is significantly faster than the dead plate pushover in-line filler design, as well as the single lane in-line design. Note that in the examples where the container fill times

TABLE 9

COMPARATIVE SPEED CAPABILITY OF A SHIFTING NOZZLE DUAL LANE IN-LINE FILLER

| | Machine Function Times (mS) | Fill Time A 750 (mS) | Fill Time B 1500 (mS) | Fill Time C 3000 (mS) |
|---|---|---|---|---|
| T1 | Nozzle Dive Time—Lane 1 | 500 | 500 | 500 |
| T2 | Container Fill Time—Lane 1 | 750 | 1500 | 3000 |
| T3 | Nozzle Retract Time—Lane 1 | 500 | 500 | 500 |

TABLE 9-continued

COMPARATIVE SPEED CAPABILITY OF A SHIFTING NOZZLE DUAL LANE IN-LINE FILLER

| | Machine Function Times (mS) | Fill Time A 750 (mS) | Fill Time B 1500 (mS) | Fill Time C 3000 (mS) |
|---|---|---|---|---|
| T4 | Container Index Time—Lane 1 | 3000 | 3000 | 3000 |
| T5 | Nozzle Shift Time—Lane 1 to Lane 2 | 500 | 500 | 500 |
| T6 | Nozzle Dive Time—Lane 2 | 500 | 500 | 500 |
| T7 | Container Fill Time—Lane 2 | 750 | 1500 | 3000 |
| T8 | Nozzle Retract Time—Lane 2 | 500 | 500 | 500 |
| T9 | Container Index Time—Lane 2 | 3000 | 3000 | 3000 |
| T10 | Nozzle Shift Time—Lane 2 to Lane 1 | 500 | 500 | 500 |
| | Total Cycle Time | 6000 | 6000 | 9000 |
| | Cycles Per Minute | 10 | 10 | 6.6 |
| | Containers Per Minute | 200 | 200 | 133.2 |

Note 1:
T4, Container Index Time—Lane 1, and T9, Container Index Time—Lane 2, are of identical value and can be interchanged for computation purposes. Likewise, T1 and T6 are equal, T2 and T7 are equal, T3 and T8 are equal, and T5 is equal to T10.
Note 2:
If T4 (or T9) is greater than or equal to the sum of T5 + T6 + T7 + T8 + T10 then the Total Cycle Time is T4 + T9.
If T4 (or T9) is less than the sum of T5 + T6 + T7 + T8 + T10, then the Total Cycle Time is T1 + T2 + T3 + T5 + T6 + T7 + T8 + T10.
Note 3:
Each complete machine cycle results in twenty filled containers.

TABLE 10

COMPARATIVE EFFECTS ON SHIFTING NOZZLE DUAL LANE IN-LINE FILLING MACHINE SPEED WITH ADDITION OF FILLING POSITIONS: 750 mS CONTAINER FILL TIME

| Number of Filling Positions | Containers Per Minute | Unit Per Minute | Percent Increase |
|---|---|---|---|
| 10 | 200 | — | — |
| 11 | 200 | — | — |
| 12 | 200 | — | — |
| 13 | 200 | — | — |
| 14 | 200 | — | — |
| 15 | 200 | — | — |
| 16 | 200 | — | — |

TABLE 11

COMPARATIVE EFFECTS ON SHIFTING NOZZLE DUAL LANE IN-LINE FILLING MACHINE SPEED WITH ADDITION OF FILLING POSITIONS: 1500 mS CONTAINER FILL TIME

| Number of Filling Positions | Containers Per Minute | Unit Per Minute | Percent Increase |
|---|---|---|---|
| 10 | 200 | — | — |
| 11 | 200 | — | — |
| 12 | 200 | — | — |
| 13 | 200 | — | — |
| 14 | 200 | — | — |
| 15 | 200 | — | — |
| 16 | 200 | — | — |

TABLE 12

COMPARATIVE EFFECTS ON SHIFTING NOZZLE DUAL LANE IN-LINE FILLING MACHINE SPEED WITH ADDITION OF FILLING POSITIONS: 3000 mS CONTAINER FILL TIME

| Number of Filling Positions | Containers Per Minute | Unit Per Minute | Percent Increase |
|---|---|---|---|
| 10 | 133.2 | — | — |
| 11 | 146.52 | 13.32 | 10 |
| 12 | 159.84 | 13.32 | 9.1 |
| 13 | 173.16 | 13.32 | 8.33 |
| 14 | 186.48 | 13.32 | 7.69 |
| 15 | 199.8 | 13.32 | 7.14 |
| 16 | 213.12 | 13.32 | 6.66 |

are of 750 mS and 1500 mS duration, the index time for ten containers in either lane is longer than the other constituents of the machine cycle; nozzle shift time (from one lane to the other), nozzle dive time, container fill time, nozzle retract time, and nozzle shift time (to the other lane). When this is the case, the machine's cycle speed is determined by the sum of the serial container index time of each lane. This is true because after nozzle shift from one lane, the container index process has not been completed on the other lane. Thus, the next nozzle dive-fill-retract and re-shift sequence cannot begin until indexing has finished.

It is also important to understand that with the shifting nozzle dual lane design, as long as the container index time exceeds the other cycle functions, there cannot be any increase in speed with an increase in the number of filling stations operating on the machine. This is the case because each additional fill station added increases the container transfer time in a linear manner. For example, increasing filling positions from ten to eleven, with 300 mS transfer time per container, increases the container transfer or index time from 3000 mS to 3300 mS, an increase of precisely ten percent. Likewise, with each container index, the number of filled containers increases in direct ratio to the number of filling positions. For example, increasing filling positions per lane from ten to eleven increases the number of filled containers released per index cycle by exactly ten percent. Thus, it can be seen that the increase in number of filled containers per cycle is exactly offset or canceled by the increased container index time. Therefore, with this machine architecture, the addition of filling positions can have no effect on machine output speed as long as the container index time exceeds the sum of the other machine cycle function times.

Once the container fill time, in sum with the other machine cycle functions, but exclusive of container indexing, exceeds the container indexing time, the shifting nozzle layout yields a different result as filling positions are added. In this second case, the output speed relationship is precisely reversed from the prior case. In this instance, output increases in exact ratio to the increase in filling positions. This can be understood by noting that increases in container transfer times as a function of adding filling positions is irrelevant to output speeds as long as the container indexing times are less than the sum of the times of the other cycle functions. For example, at a 3000 mS container filling time, increasing filling positions ten percent from ten to eleven increases container index time from 3000 mS to 3300 mS. This is less than the sum of the other cycle constituents and thus the output goes up by ten percent (the maximum possible) without any machine cycle time penalty. In effect, the cycle time remains the same but ten percent more filled containers are produced with each cycle. This phenomenon continues until the time relationships reverse at which point the mathematics of the first case prevail.

The shifting nozzle design preserves some of the characteristics of merit of in-line fillers while impairing others. The diving nozzle function is preserved but is substantially more complex in that movement horizontally from lane to lane is required as well as vertical motion. The use of vacuum aspiration as well as the use of many different types of filling nozzles, including positive shut-off types, is unimpaired by this design variant. The modular addition of filling positions is not generally affected. The ability to implement a gas purge function, on the fly adjustment ability, and the ability to discretely adjust each function segment of the machine cycle are all unaffected as a consequence of this design architecture. In terms of ease of changeover, there are many more adjustments with the shifting nozzle design. In terms of the machine's flexibility and versatility, the variability of liquid products and size range of containers is not influenced by this design variant and thus these characteristics of merit are not restricted in any manner. Implementation of a no container-no fill function requires double the hardware and adjustments compared with a single lane design, as does implementation of a container capture function.

Figure 5:
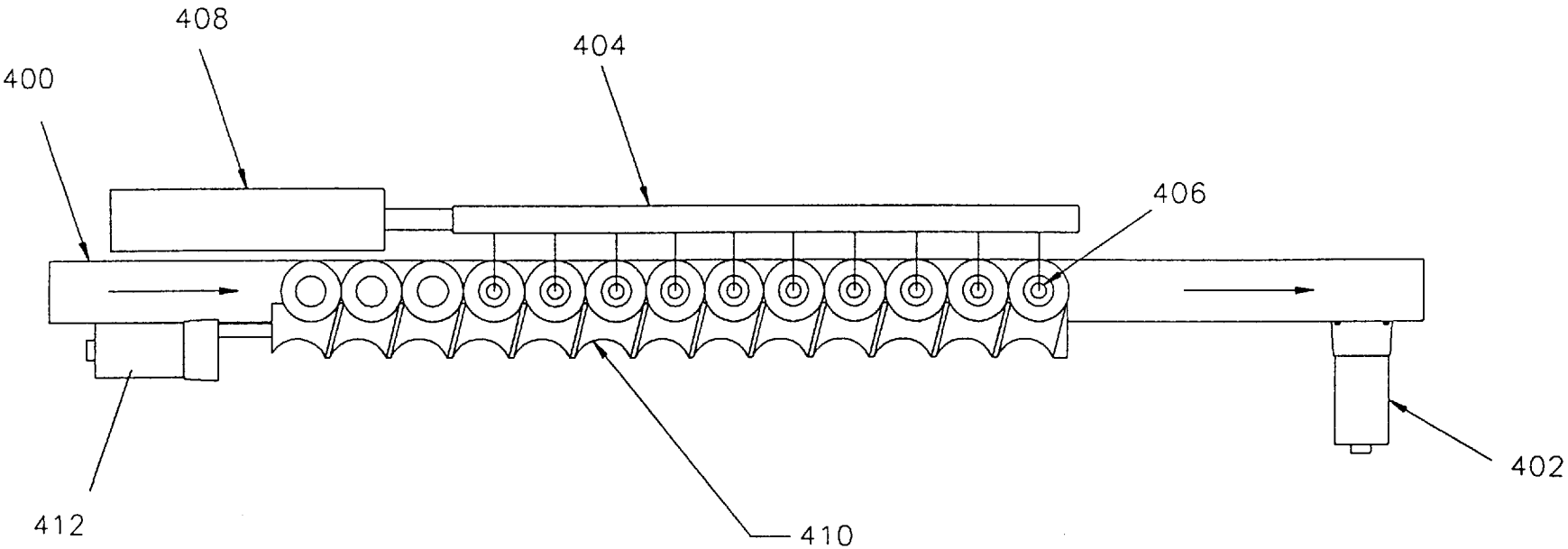
FIGURE 5 PRIOR ART
FIG. 5 is a schematic plan view of a prior art walking beam in-line liquid filling machine.

The third increased speed in-line filler derivative of known type to be compared with the single lane in-line filler is termed the walking beam in-line filler design, which is shown in a simplified schematic plan view in FIG. 5. This design consists of a single powered conveyor 400 driven by drive 402, the conveyor being fitted with suitable container guide rails such that it is capable of guiding and conveying the containers to be filled. A filling nozzle mount beam 404 provides means to attach nozzles 406, one adjacent to the next, such that each nozzle is centered on the opening of a container C to be filled, each container being adjacent to the next. The filling nozzle mount beam is suitably affixed to a walking beam mechanism 408 which provides means to move the nozzles along the conveyor in unison or synchronization with the movement of the containers, the walking beam mechanism also being capable of moving back toward the conveyor infeed at a rate of speed relatively greater than the speed of the conveyor chain. In operation, these major elements function such that the conveyor establishes a continuous jam fed flow of containers along its length. The rate of flow of containers in the ten container filling area (in this example) is typically mediated and regulated by a suitable length and shape timing screw 410 or helix which is driven by a screw drive 412. This device assures that containers move through the filling area at a relatively stable and constant rate free of significant change in rate as a result of varying line pressure of containers entering the filler. The filling cycle begins when the walking beam is accelerated from rest to match the rate of movement of continuously moving containers, and the nozzles are positioned directly over the container openings. The nozzles are then lowered into the containers and filling occurs while the walking beam and containers continue to move along the conveyor in unison. Upon the completion of filling, the nozzles are retracted from the containers and the forward motion of the beam is stopped and then reversed. The beam is moved at a rapid rate back toward the conveyor infeed and stops at a home position. This completes a full machine cycle.

Table 13 shows, in table form, computations for machine functions and output speeds at three different container fill times for a ten filling station walking beam in-line design, and Tables 14–16 show computations with differing numbers of fill positions. Note that the functions common to a single lane in-line design, a dead plate pushover design and a shifting nozzle dual lane design, use the same values as before.

At a container filling time of 750 mS, the walking beam design is somewhat slower than the shifting nozzle dual lane layout, but significantly faster than the dead plate pushover in-line layout and the single lane in-line machine. At a container filling time of 1500 mS, the walking beam design is markedly slower than the shifting nozzle system and moderately slower than the dead plate system, but remains faster than the single lane version. At a container filling time of 3000 mS, the walking beam system is slower than any of the other variants. Note that as the liquid fill time increases, the distance the nozzles must travel along the conveyor, in synchronized movement with the containers, increases. Thus, the beam return time, even at a comparatively higher rate of speed increases in significance relative to the total machine cycle time. This accounts for the non-linear and unfavorable decrease in total machine output relative to increasing container filling times.

TABLE 13

SPEED CAPABILITY OF A WALKING BEAM IN-LINE FILLER

| Machine Function Times (mS) | Fill Time A 750 (ms) | Fill Time B 1500 (mS) | Fill Time C 3000 (mS) |
|---|---|---|---|
| Speed Synchro. Time | 250 | 250 | 250 |
| Nozzle Dive Time | 500 | 500 | 500 |
| Container Fill Time | 750 | 1500 | 3000 |
| Nozzle Retract Time | 500 | 500 | 500 |
| Beam Return Time | 1333 | 1833 | 2833 |
| Total Cycle Time | 3333 | 4583 | 7083 |
| Cycles Per Minute | 18.02 | 13.09 | 8.48 |
| Containers Per Minute | 180.2 | 130.9 | 84.8 |

TABLE 14

COMPARATIVE EFFECTS ON WALKING BEAM IN-LINE FILLING MACHINE SPEED WITH ADDITION OF FILLING POSITIONS: 750 mS CONTAINER FILL TIME

| Number of Filling Positions | Containers Per Minute | Unit Per Minute | Percent Increase |
|---|---|---|---|
| 10 | 180.2 | — | — |
| 11 | 198.22 | 18.02 | 10 |
| 12 | 216.26 | 18.04 | 9.1 |
| 13 | 234.27 | 18.01 | 8.33 |
| 14 | 252.31 | 18.04 | 7.69 |
| 15 | 270.22 | 17.91 | 7.14 |
| 16 | 288.05 | 17.83 | 6.66 |

TABLE 15

COMPARATIVE EFFECTS ON WALKING BEAM IN-LINE FILLING MACHINE SPEED WITH ADDITION OF FILLING POSITIONS 1500 mS CONTAINER FILL TIME

| Number of Filling Positions | Containers Per Minute | Unit Per Minute | Percent Increase |
|---|---|---|---|
| 10 | 130.9 | — | — |
| 11 | 143.99 | 13.09 | 10 |
| 12 | 157.08 | 13.09 | 9.1 |
| 13 | 170.17 | 13.09 | 8.33 |
| 14 | 183.26 | 13.09 | 7.69 |
| 15 | 196.34 | 13.08 | 7.14 |
| 16 | 209.3 | 12.96 | 6.66 |

TABLE 16

COMPARATIVE EFFECTS ON WALKING BEAM IN-LINE FILLING MACHINE SPEED WITH ADDITION OF FILLING POSITIONS: 3000 mS CONTAINER FILL TIME

| Number of Filling Positions | Containers Per Minute | Unit Increase | Percent Increase |
|---|---|---|---|
| 10 | 84.8 | — | — |
| 11 | 93.28 | 8.48 | 10 |
| 12 | 101.76 | 8.48 | 9.1 |
| 13 | 110.24 | 8.48 | 8.33 |
| 14 | 118.72 | 8.48 | 7.69 |
| 15 | 127.15 | 8.43 | 7.14 |
| 16 | 135.54 | 8.39 | 6.66 |

In the case of the walking beam in-line design, the addition of filling positions increases the output of the machine in exact proportion to the percent increase in filling positions. This relationship holds true in all cases, and is valid because the addition of filling stations does not change the nature or duration of any machine motion. The distance the beam must travel with the containers, and thus the distance of the return travel, are determined only by the container filling time, not by the number of fill positions.

The walking beam in-line filler design preserves some of the characteristics of merit of in-line fillers, while impairing others and prohibiting still others. The diving nozzle function is preserved, but is much more complex in that the nozzles must move at a precise rate horizontally in the direction of conveyor travel as well as vertically. The ability to utilize vacuum aspiration or implement a gas purge function are unimpaired by this design variant. The use of many different types of filling nozzles is possible, but is restricted because of the propensity of some types to drip with the relatively large and rapid motions necessitated by the walking beam design. The modular addition of filling positions is relatively unrestricted in principle, but more severe limitations may be imposed in practice due to the limits of mass which may be allowed to be added to the walking mechanism. Because of its synchronized and interlocked nature, the ability to adjust the machine while in operation is generally prohibited as is the ability to readily adjust each functional segment of the machine cycle discretely. The ease and speed of changeover are also adversely impacted by this design. This is true because the container timing screw must be removed and replaced by a variant unit with each change in container geometry. This is typically a laborious process and requires an expensive and relatively large change part. The flexibility and versatility of the machine can typically be somewhat reduced in that the timing screw and overall size of the machine and walking beam mechanism make construction of a system to cover a large range of container sizes, from small to large, difficult and expensive.

FIRST PREFERRED EMBODIMENT

Figure 6:
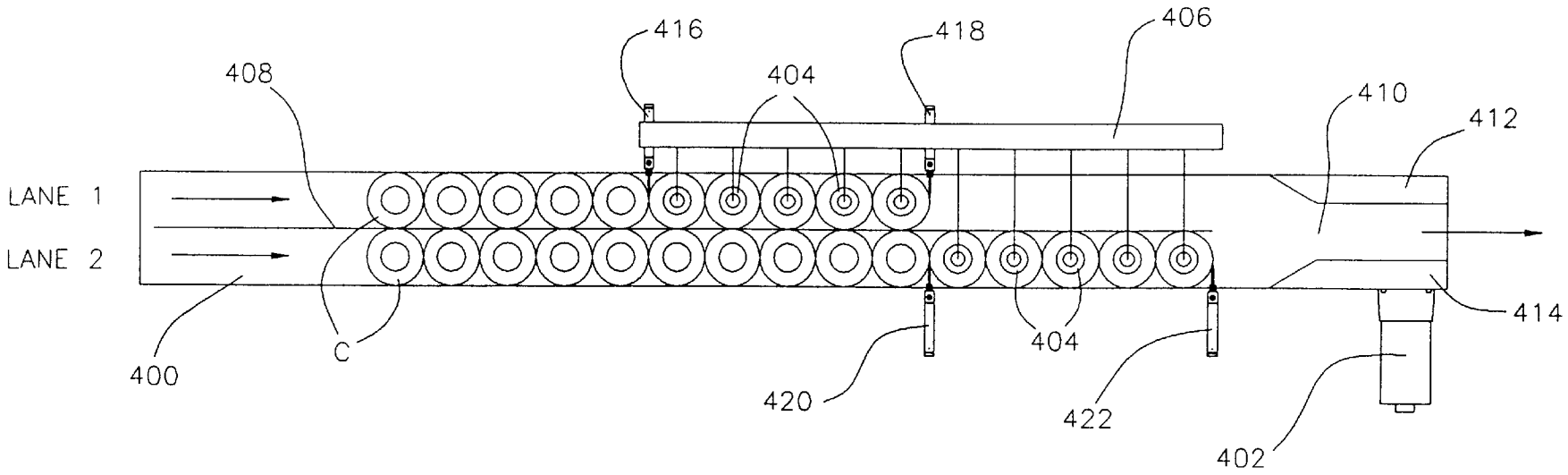
FIG. 6 is a schematic plan view of the first embodiment of a parallel processing liquid filling machine of this invention showing two parallel lanes.

FIG. 6 illustrates, in schematic form, a plan view of a two parallel lanes in-line filler of the present invention. This machine consists of a single powered conveyor 400 suitably driven by a drive 402. Individual containers C are supported on the conveyor. Filling nozzles 404 are supported by a filling nozzle mount beam 406. The movement of the containers C is controlled by various gates of a conventional design. A comparison of the traditional single lane in-line liquid filling machine as shown in FIG. 1, with the two parallel lanes design disclosed in FIG. 6 shows that only a lane divider 408, and a second set of indexing gates have been added to achieve a large increase in machine speed capability. These added devices are comparatively simple and inexpensive and cause little change in economic cost of the machine. The lane merge area, indicated generally at 410 is simply a change in the bend geometry of the conveyor container guide rails 412 and 414 and carries no economic implication. Note particularly that no new motion or different mechanism or apparatus or cycle time component has been added to the machine, consistent with the objects of this invention. This minimal addition of hardware, costs and cycle time are consistently true for the three parallel lanes design shown in FIG. 7 as well.

In operation, all containers C in lanes 1 and 2, when in the position shown in FIG. 6, are first simultaneously and completely filled with a liquid during a fill time period. During the fill time period, the index gate 416 and fill gate 418 for lane 1 are extended. In addition, the index gate 420 and fill gate 422 for lane 2 are extended. At the conclusion of the fill time period, the gates 416–422 are retracted, simultaneously releasing the various containers. The filled containers are replaced with empty containers during an index time period. When the gates 416–422 are extended at the completion of the index time period, each container in the row in lane 1 which is to be filled is positioned such that it is at least entirely offset or staggered from the position of the containers to be filled in lane 2 thus allowing simultaneous parallel filling followed by simultaneous parallel indexing of all containers in all rows without the possibility of one container group in any given row intersecting or colliding with any other container group in any other row following release from the filling positions.

Table 17 shows computations for machine functions and output speeds at three different container fill times for the ten filling station two parallel lanes design shown in FIG. 6, and Tables 18–20 show computations with differing numbers of fill positions. Note that the functions common to a single lane in-line design, a dead plate pushover design, a shifting nozzle dual lane design, and a walking beam in-line filling machine use the same values as before. The machine cycle begins with the container index time which constitutes the time required for ten (in the example given) filled containers to leave the ten filling station area and be replaced by ten empty containers. As previously explained, in the present invention, while all ten containers move simultaneously, only five move on each parallel lane. Thus, in the present invention, a linear distance equivalent to ten containers is committed to filling, just as is the case in a conventional single lane in-line machine but a linear distance of only five containers per lane is committed to indexing. Thus, no increase in machine length or in the length of the container conveyor is required as a function of the novel layout of the design to achieve the enhanced speed capability.

TABLE 17

COMPARATIVE SPEED CAPABILITY OF A FIRST EMBODIMENT OF A PARALLEL PROCESSING LIQUID FILLING MACHINE -TWO PARALLEL LANES-

| Machine Function Times (mS) | Fill Time A 750 (ms) | Fill Time B 1500 (mS) | Fill Time C 3000 (mS) |
|---|---|---|---|
| Container Index Time | 1500 | 1500 | 1500 |
| Nozzle Dive Time | 500 | 500 | 500 |
| Container Fill Time | 750 | 1500 | 3000 |
| Nozzle Retract Time | 500 | 500 | 500 |
| Total Cycle Time | 3250 | 4000 | 5500 |
| Cycles Per Minute | 18.46 | 15 | 10.91 |
| Containers Per Minute | 184.6 | 150 | 109.1 |

TABLE 18

COMPARATIVE EFFECTS ON FIRST EMBODIMENT PARALLEL PROCESSING IN-LINE LIQUID FILLING MACHINE SPEED WITH ADDITION OF FILLING POSITIONS: 750 mS CONTAINER FILL TIME -TWO PARALLEL LANES-

| Number of Filling Positions | Containers Per Minute | Unit Increase | Percent Increase |
|---|---|---|---|
| 10 | 184.6 | — | — |
| 12 | 202.8 | 18.2 | 9.86 |
| 14 | 218.12 | 15.32 | 7.55 |
| 16 | 231.36 | 13.24 | 6.07 |

TABLE 19

COMPARATIVE EFFECTS ON FIRST EMBODIMENT PARALLEL PROCESSING IN-LINE LIQUID FILLING MACHINE SPEED WITH ADDITION OF FILLING POSITIONS: 1500 mS CONTAINER FILL TIME -TWO PARALLEL LANES-

| Number of Filling Positions | Containers Per Minute | Unit Increase | Percent Increase |
|---|---|---|---|
| 10 | 150 | — | — |
| 12 | 167.4 | 17.4 | 11.6 |
| 14 | 182.56 | 15.16 | 9.06 |
| 16 | 196 | 13.44 | 7.36 |

TABLE 20

COMPARATIVE EFFECTS ON FIRST EMBODIMENT PARALLEL PROCESSING IN-LINE LIQUID FILLING MACHINE SPEED WITH ADDITION OF FILLING POSITIONS: 3000 mS CONTAINER FILL TIME -TWO PARALLEL LANES-

| Number of Filling Positions | Containers Per Minute | Unit Increase | Percent Increase |
|---|---|---|---|
| 10 | 109.1 | — | — |
| 12 | 124.2 | 15.1 | 13.84 |
| 14 | 137.76 | 13.56 | 10.92 |
| 16 | 150.08 | 12.32 | 8.94 |

The nozzle dive time is the next step in the machine cycle and is the period from the start of downward travel of the filling nozzles until the nozzles are fully lowered to the desired position onto or about or inside of the containers to be filled. The diving nozzle mechanism, function and speed need not be altered in any way from a suitable design as found in a single lane machine in order to be suitable for use on a parallel lane machine such as herein disclosed.

After the nozzle dive time, container filling begins. The container fill time is the absolute filling time required to deliver the desired quantity of liquid into the container being filled, from start of liquid flow to end of liquid flow. There is no distinction or change in this portion of machine cycle time as a function of the design herein presented. After the completion of the container fill time, nozzle retraction occurs. This motion is simply the reverse of the nozzle dive motion and constitutes the interval of time from the start of nozzle withdrawal from on or about or within the container to the return of the filling nozzles to a full up position. Taken together, the machine functions of container indexing, nozzle dive, container filling and nozzle retraction constitute a complete machine cycle of a parallel lane machine of the present invention. It is the point of this analysis and explanation of this machine cycle to show that the parallel lane machine cycle is identical with that of a single lane in-line liquid filling machine of known type, yet operates at substantially greater speed than the single lane design.

In order to further point out the relative advantages of this invention, it is useful to compare the speed performance of the new design with the speed performance of known designs. Thus, by way of illustration and example, a comparison of a two parallel lanes ten filling position in-line filler of the present invention with a ten filling position single lane in-line filler of known type, with all machine cycle functions being identical except for total container index time, shows the parallel lanes embodiment to be substantially faster. Referring to Table 1, with a fill time of 750 mS the single lane machine produces 126 filled containers per minute. Referring to Table 17, the two parallel lanes machine of the present invention produces 184 filled containers per minute. Note that the 300 mS index time per container is the same for both machines. At a fill time of 1500 mS, the single lane machine produces 109 filled containers per minute, while the two parallel lanes design produces 150. At a fill time of 3000 mS, the single lane machine produces 85 containers per minute, while the two parallel lanes design produces 109 per minute. By comparing Tables 2–4 with Tables 18–20 the effects of adding filling positions to a single lane machine and to a two parallel lanes machine can be discerned, and it can be seen that the two lane parallel processing in-line liquid filling machine of this invention has a substantially greater output at all tabulated filling positions.

The speed performance of a dead plate push over in-line liquid filler is detailed in Tables 5–8. This data may be contrasted with data for a two parallel lanes design as given in Tables 17–20. Comparison shows that the design of the present invention produces greater speeds than those of the comparable dead plate design until increased filling time causes the total cycle time of the parallel machine to exceed that of the dead plate machine.

The speed performance of a shifting nozzle dual lane in-line filler is given in Tables 9–12. This performance may be contrasted with that of the two parallel lanes design detailed in Tables 17–20. Comparison shows that at ten filling positions, the shifting nozzle design is faster. However, with the addition of filling positions, the shifting nozzle design cannot increase speed until fill times exceed the other cycle time components. Thus, the new design is faster at comparatively short filling times.

The speed performance of a walking beam in-line filler is given in Tables 13–16. When contrasted with two parallel lanes Tables 17–20 the new design is faster at all filling times at ten filling positions. At a 750 mS filling time, addition of filling heads increases the speed of both designs, but the walking beam increases at a greater rate. At a 1500 mS filling time the two designs have relatively similar speed capabilities, while at a 3000 mS filling time, the new design is faster. In an overall ranking of the speed performance of the new design with all of the other designs, the two parallel lanes embodiment herein disclosed is faster in 30 of the 48 direct comparisons computed. In two other instances its speed is 98% of the speed of the other comparative architecture.

A comparison of the dead plate push over in-line liquid filling machine as shown in FIG. 2, with the two parallel lanes design disclosed in FIG. 6 points up the substantially greater complexity and cost of the dead plate design. The dead plate design utilizes two separate conveyors with two separate drives. These are typically very expensive components relative to the total cost of a filling machine. A container push bar and push bar drive mechanism must be added as well as suitable mounts. A container dead plate must be provided and mounted suitably. An index backer blade and articulating mount and drive mechanism must be added to the machine. Taken separately and as a whole these particular features of the dead plate design add greatly to machine cost and complexity. There are also additional cycle time components imposed by the design, and a completely new motion, the push over of containers at right angles to the direction of conveyor travel, has been added as well. It is therefore clear that the minimal and simple additions required of a two (or three) parallel lanes design compares very favorably to the dead plate design, consistent with the objects of the invention.

A comparison of the shifting nozzle dual lane liquid filling machine, as shown in FIGS. 3 and 4, with the two parallel lanes design disclosed in FIG. 6, clearly shows the significantly greater complexity and cost of the shifting nozzle design. The shifting nozzle design requires the addition of a lane divider and a second set of index gates just as does the present invention. However, in addition, a horizontal shifting motion must be added to the diving nozzle mechanism. This requires a second drive mechanism and extensive additions of linear bearings, guides, mounts and attachments to the diver, as well as a much more robust structural framing and mounting to accommodate the additional mechanism. This is particularly true because the mass of the filling nozzles and nozzle mount beam could easily exceed one hundred pounds. This amount of mass, moved several inches horizontally in 500 mS, requires substantial construction at comparatively high cost. Thus it can be seen that these requirements of a shifting nozzle design add significantly to machine cost and complexity. It is therefore clear that the minimal and simple additions required of two (or three) parallel lanes designs compares very favorably to the shifting nozzle design, consistent with the objects of this invention.

A comparison of the walking beam in-line liquid filler design, as shown in FIG. 4, with the two parallel lanes design disclosed in FIG. 6, clearly shows the significantly greater complexity and cost of the walking beam design. The walking beam design requires the addition of a container timing screw and drive. this drive must be particularly stable and reproducible, and is typically implemented utilizing a servo motor and electronic servo motor controller. The screw and drive typically add at least ten percent of additional cost to the machine. A horizontal precision tracking or walking mechanism must also be added to the diving nozzle mechanism. Because this motion must be particularly repeatable and stable and because this motion must precisely coordinate in time and rate with the container timing screw, a servo motor and electronic servo motor controller are typically utilized. In addition, the walking mechanism requires extensive additions of linear bearings, guides, mounts and attachments, as well as robust structural framing and mounting to accommodate the additional mechanism. Accordingly, the walking beam function will typically drive machine cost up by an additional fifteen percent or more. Thus it can be seen that these requirements of a shifting nozzle design add very substantial complexities and costs to the design. Therefore, it is clear that the minimal, simple and very low cost additions required to implement a two (or three) parallel lanes design compares very favorably to the walking beam design, consistent with the objects of this invention.

The parallel lanes design embodiments completely preserve, without alteration or compromise, the ability to simply and economically provide means to lower or dive the filling nozzles into the container for precision bottom-up or subsurface filling; the ability to vacuum aspirate the filling nozzles to prevent dripping following subsurface filling; the ability to readily and simply implement real time no container-no fill detection and inhibition functions, particularly in all filling positions; the ability to readily use many different types of filling nozzles, including bottom shut-off or positive shut-off filling nozzles; the ability to readily implement a nitrogen (or other gas) purge, concurrent fill container gas purge, or post-fill container gas purge function; the ability to readily adjust filling volumes or levels or weights while the machine is operating (termed "on the fly" adjustment); the ability to separately and discretely adjust and alter the various machine functions and timing relationships; the ability to implement product pull-back or suck-back at each filling nozzle on an individual adjustment basis; the ability to simply locate and capture the neck or body of each container to assure proper position and alignment of the container with the filling nozzle during filling or to assure proper positioning of a filling nozzle for lowering onto or into the container prior to filling.

SECOND PREFERRED EMBODIMENT

The design of the present invention may be readily varied such that more than two parallel lanes may be utilized to good effect to further improve upon machine speed. Thus a second embodiment of the invention disclosing a three lane design is disclosed in FIG. 7, and will be comparatively analyzed further on for speed capability. With regard to details of construction and machine cycle sequence, the three lane design is essentially the same as the two lane design. Thus it includes a single powered conveyor 500 suitably driven by a drive 502. Individual containers C are supported on the conveyor. Filling nozzles 504 are supported by a filling nozzle mount beam 506. The movement of the containers C is controlled by various gates of a conventional design. Three lanes dividers are provided to establish 4 lanes, namely lanes 1, 2, and 3 which are used to receive rows of containers C, and lane X which is used to receive various gates. In addition, the three lane design also has a lane merge area, indicated generally at 510, which lane merge area is defined by guide rails 512 and 514.

Figure 7:
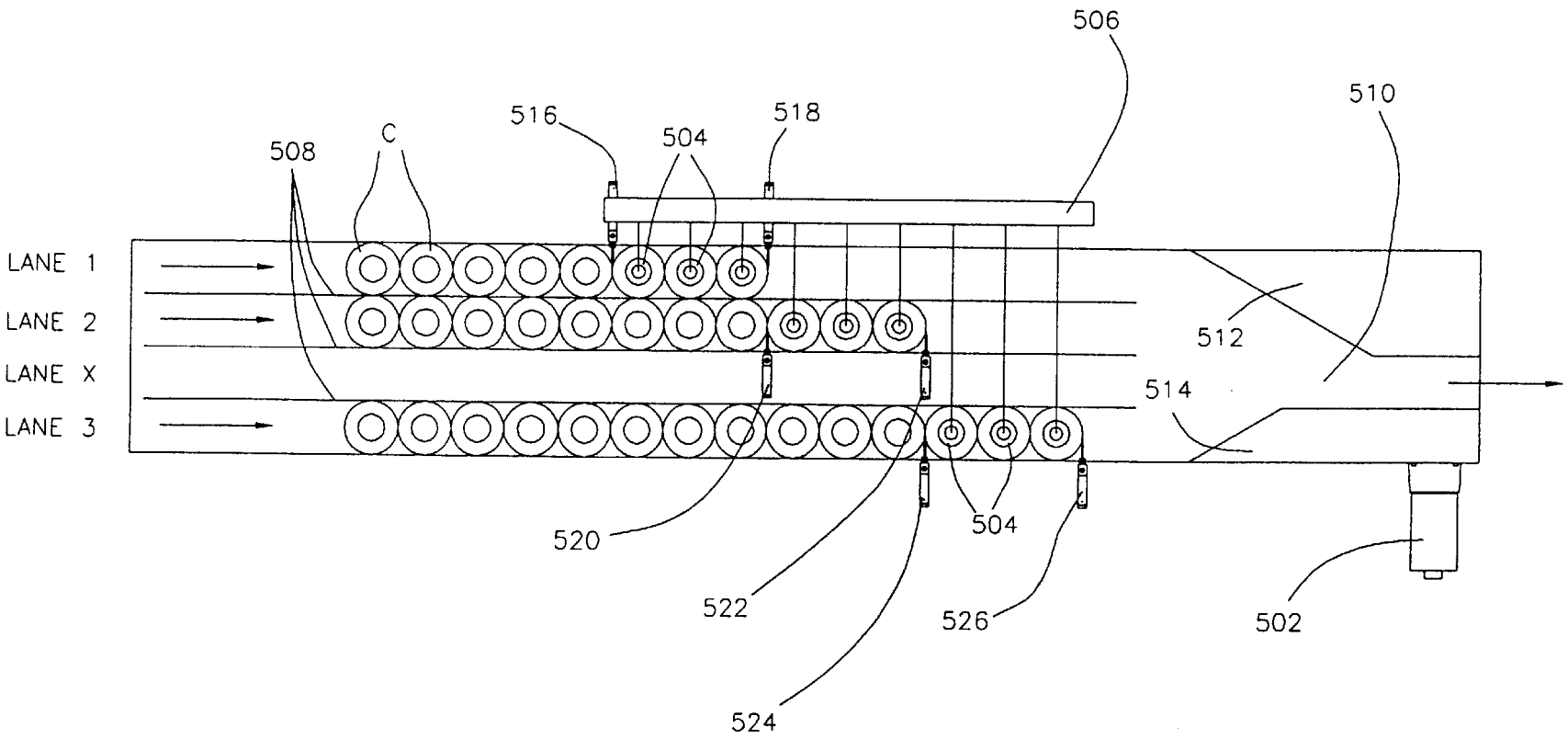
FIG. 7 is a schematic plan view of the second embodiment of a parallel processing liquid filling machine of this invention showing three parallel lanes.

In operation, all containers C in lanes 1, 2, and 3, when in the position shown in FIG. 7, are first simultaneously and completely filled with a liquid during a fill time period. During the fill time period, the index gate 516 and fill gate 518 for lane 1 are extended, the index gate 520 and fill gate 522 for lane 2 are extended, and the index gate 524 and fill gate 526 for lane 3 are extended. At the conclusion of the fill time period, the gates 516–526 are retracted, simultaneously releasing the various containers. The filled containers are replaced with empty containers during an index time period. When the gates 516–526 are extended at the completion of the index time period, each container in the row in lane 1 which is to be filled is positioned such that it is at least entirely offset or staggered from the position of the containers to be filled in lanes 2 and 3, and similarly, each container in the row in lane 2 which is to be filled is positioned such that it is at least entirely offset or staggered from the position of the containers to be filled in lane 3, thus allowing simultaneous parallel filling followed by simultaneous parallel indexing of all containers in all rows without the possibility of one container group in any given row intersecting or colliding with any other container group in any other row following release from the filling positions.

It is apparent that a machine of more than three lanes could be readily constructed in a manner similar to that herein disclosed and that such a machine would function and cycle in essentially the same manner as embodied in a two or three lane design with a corresponding increase in throughput.

The major machine functions which contribute to a total machine cycle time are listed in Table 21 and provides the same comparison with a two parallel lanes design set forth in Table 17. As can be readily seen, the parallel lanes designs are much faster at all filling times. Tables 22–24 provide the same comparison for a three lanes version as Tables 18–20 for the two lane version. In each instance of comparison, the absolute increase and percentage increase in speeds are much greater for the new design.

It is important to note, in conjunction with this comparison of the addition of filling positions, that when filling positions are added to the parallel lanes design such additions should be made equally to each lane. Thus, for a two lane machine, expansion of filling positions

TABLE 21

COMPARATIVE SPEED CAPABILITY OF SECOND EMBODIMENT OF A PARALLEL PROCESSING LIQUID FILLING MACHINE -THREE PARALLEL LANES-

| Machine Function Times (mS) | Fill Time A 750 (ms) | Fill Time B 1500 (mS) | Fill Time C 3000 (mS) |
|---|---|---|---|
| Container Index Time | 900 | 900 | 900 |
| Nozzle Dive Time | 500 | 500 | 500 |
| Container Fill Time | 750 | 1500 | 3000 |
| Nozzle Retract Time | 500 | 500 | 500 |
| Total Cycle Time | 2650 | 3400 | 4900 |
| Cycles Per Minute | 22.64 | 17.65 | 12.25 |
| Containers Per Minute | 203.76 | 158.85 | 110.25 |

TABLE 22

COMPARATIVE EFFECTS ON SECOND EMBODIMENT PARALLEL PROCESSING IN-LINE LIQUID FILLING MACHINE SPEED WITH ADDITION OF FILLING POSITIONS: 750 mS CONTAINER FILL TIME -THREE PARALLEL LANES-

| Number of Filling Positions | Containers Per Minute | Unit Increase | Percent Increase |
|---|---|---|---|
| 9 | 203.76 | — | — |
| 12 | 244.08 | 40.32 | 19.79 |
| 15 | 276.9 | 32.82 | 13.45 |

TABLE 23

COMPARATIVE EFFECTS ON SECOND EMBODIMENT PARALLEL PROCESSING IN-LINE LIQUID FILLING MACHINE SPEED WITH ADDITION OF FILLING POSITIONS: 1500 mS CONTAINER FILL TIME -THREE PARALLEL LANES-

| Number of Filling Positions | Containers Per Minute | Unit Increase | Percent Increase |
|---|---|---|---|
| 9 | 158.85 | — | — |
| 12 | 194.64 | 35.79 | 22.53 |
| 15 | 225 | 30.36 | 15.6 |

TABLE 24

COMPARATIVE EFFECTS ON SECOND EMBODIMENT PARALLEL PROCESSING IN-LINE LIQUID FILLING MACHINE SPEED WITH ADDITION OF FILLING POSITIONS: 3000 mS CONTAINER FILL TIME -THREE PARALLEL LANES-

| Number of Filling Positions | Containers Per Minute | Unit Increase | Percent Increase |
|---|---|---|---|
| 9 | 110.25 | — | — |
| 12 | 138.48 | 28.23 | 25.61 |
| 15 | 163.65 | 25.17 | 18.18 |

should be in multiples of two, while for a three lane machine multiples of three should be used.

When the three parallel lane embodiment is compared, as given in Tables 21–24, it can be seen that the new design is faster than the dead plate push-over design set forth in Tables 5–8, at relatively short filling times, and can exceed the shifting nozzle design speed at moderate fill times with the addition of filling positions. With respect to the shifting nozzle dual lane design, the performance of which is set forth in Tables 9–12, it can be seen that the new three lane design is faster at relatively short filling times, and can exceed the shifting nozzle design speed at moderate fill times with the addition of filling positions.

In an overall ranking of the speed performance of the new design with all of the other designs, the three parallel lanes embodiment herein disclosed is faster in 30 of the 36 direct comparisons computed. In one other instance its speed is 98% of the speed of the other comparative architecture.

With respect to both the 2 and 3 lane designs, it should be noted that an additional important capability of single lane in-line liquid filler designs of known type which is nearly unimpaired by the parallel lanes design herein disclosed, particularly when compared with the losses, reductions, or impairments necessitated by other higher speed in-line designs of known type, includes the speed and ease of changeover from one product type or container size to another. The two parallel lanes design requires only the relocation of one additional pair of index gates and the movement of one additional container guide rail to achieve a changeover. The three parallel lanes design requires only the relocation of two additional sets of index gates and the movement of two additional container guide rails. In either case, this typically consumes only a few minutes and is therefore a very small reduction to the speed and ease of changeover. In addition, there is no limitation whatsoever imposed by the design in the size of containers or range of liquid products which can be run on the parallel lanes design without need of change parts or machine additions or alterations. The design of the present invention also allows the ability to readily add or delete filling positions on the machine in a modular way without need for change parts of any type, limited only by the need to add a position in each lane when such additions are made.

Thus, overall, it can be readily seen that, in comparison with the other known higher speed in-line filler designs, such detailed comparisons having been previously made, the parallel lanes design herein disclosed most nearly preserves the characteristics of merit, and completely preserves the flexibility and versatility of machine function and utilization as defined and established by the single lane in-line liquid filling machine.

While a preferred form of this invention has been described above and shown in the accompanying drawings, it should be understood that applicant does not intend to be limited to the particular details described above and illustrated in the accompanying drawings, but intends to be limited only to the scope of the invention as defined by the following claims.

What is claimed is:

1. A method for filling a plurality of containers with liquid in such a way that the period required for a group of filled containers to move out of the filling area to be replaced by a group of empty containers is reduced in a manner directly proportional to the ratio of the number of containers in each group as it bears to the sum total number of containers in all groups; the method for filling comprising the following steps:

providing a number of filling nozzles arranged in staggered parallel rows;

advancing a number of the individual containers to be filled in separate but parallel rows to locations below the staggered parallel rows of filling nozzles during an initial index time period, the number of individual containers being equal to the number of filling nozzles;

filling the number of individual containers during a fill time period subsequent to the initial index time period, the number of containers being filled being held stationary during the fill time period; and simultaneously moving the filled number of containers away from the filling nozzles during a subsequent index time period without the possibility of one container in any given row intersecting or colliding with a container in any other row during the subsequent index time period.

2. The method as set forth in claim 1 further characterized by the merging the filled containers into a single lane after filling.

3. A parallel processing in-line liquid filling machine for filling a plurality of containers with liquid in such a way that the period required for a group of filled containers to move out of the filling area to be replaced by a group of empty containers is reduced in a manner directly proportional to the ratio of the number of containers in each group as it bears to the sum total number of containers in all groups; the filling machine comprising:

a number of filling nozzles arranged in staggered parallel rows;

means to advance a number of the individual containers to be filled in separate but parallel rows to locations below the staggered parallel rows of filling nozzles during an initial index time period, the number of individual containers being equal to the number of filling nozzles;

means to fill the number of individual containers during a fill time period subsequent to the initial index time period, the number of containers being filled being held stationary during the fill time period; and means to simultaneously move the filled number of containers away from the filling nozzles during a subsequent index time period without the possibility of one container in any given row intersecting or colliding with a container in any other row during the subsequent index time period.

4. The parallel processing in-line liquid filling machine as set forth in claim 3 Wherein there are at least two filling nozzles in each parallel row.

5. The parallel processing in-line liquid filling machine as set forth in claim 3 wherein the filling nozzles are arranged in two staggered parallel rows.

6. The parallel processing in-line liquid filling machine as set forth in claim 3 wherein the filling nozzles are arranged in three staggered parallel rows.

7. The parallel processing in-line liquid filling machine as set forth in claim 3 further characterized by the provision of merging means to merge the filled containers into a single lane after filling.

8. The parallel processing in-line liquid filling machine as set forth in claim 7 wherein the merging means are guide rails which passively merge the containers after they have been filled.

* * * * *